US006821177B2

(12) United States Patent
Mitomo

(10) Patent No.: US 6,821,177 B2
(45) Date of Patent: Nov. 23, 2004

(54) METHOD OF MANUFACTURING PLASMA DISPLAY PANEL AND PLASMA DISPLAY PANEL

(75) Inventor: Hiroyuki Mitomo, Yamanashi-ken (JP)

(73) Assignees: Pioneer Corporation, Tokyo (JP); Pioneer Display Products Corporation, Shizuoka (JP)

( * ) Notice: Subject to any disclaimer, the term of this patent is extended or adjusted under 35 U.S.C. 154(b) by 0 days.

(21) Appl. No.: 10/247,333

(22) Filed: Sep. 20, 2002

(65) Prior Publication Data

US 2003/0102804 A1 Jun. 5, 2003

(30) Foreign Application Priority Data

Nov. 30, 2001 (JP) ..... 2001-366448

(51) Int. Cl.[7] ..... H01J 9/00; H01J 9/38
(52) U.S. Cl. ..... 445/24; 445/25
(58) Field of Search ..... 445/6, 24, 25; 313/582–587

(56) References Cited

U.S. PATENT DOCUMENTS 6,236,159 B1 * 5/2001 Inoue et al. ..... 313/582
6,400,080 B1 * 6/2002 Tanaka ..... 313/582
6,498,593 B1 * 12/2002 Fujimoto et al. ..... 345/60

* cited by examiner

*Primary Examiner*—Ashok Patel
*Assistant Examiner*—Mariceli Santiago
(74) *Attorney, Agent, or Firm*—Arent Fox PLLC

(57) ABSTRACT

In a manufacturing process for a plasma display panel, a protective layer 3 formed of MgO is placed in a non-display area of a display space in which introduction of a discharge gas is provided, so as to face the discharge space. Bus electrodes Xb and Yb of row electrodes X and Y are increased in length to continue extending from inside a display area of the plasma display panel into the non-display area, and thus constitute a pair of discharge electrode for causing a discharge in the non-display area of the discharge space in which the introduction of the discharge gas is provided. When the discharge gas is introduced into the discharge gas, a voltage is applied between the discharge electrodes to cause an aging discharge.

16 Claims, 5 Drawing Sheets

V1—V1 SECTION

V1—V1 SECTION

W1-W1 SECTION

W—W SECTION

METHOD OF MANUFACTURING PLASMA DISPLAY PANEL AND PLASMA DISPLAY PANEL

BACKGROUND OF THE INVENTION

1. Field of the Invention

This invention relates to a plasma display panel and a method of manufacturing the plasma display panel.

The present application claims priority from Japanese Application No. 2001-366448, the disclosure of which is incorporated herein by reference for all purposes.

2. Description of the Related Art

Recent years, a surface-discharge-scheme alternating-current-type plasma display panel (hereinafter referred to as "PDP") as an oversized and slim display for color screen has been received attention, which is becoming widely available.

FIG. 7 is a perspective view of the configuration of a prior art PDP with a separation between a front glass substrate 1 and a back glass substrate 4 for illustration.

In FIG. 7, on the back surface of the front glass substrate 1, a plurality of row electrode pairs (X', Y') are regularly arranged and covered with a transparent dielectric layer 2. In turn, a transparent protective layer 3 made of MgO is formed on the back surface of the dielectric layer 2.

Each of the row electrodes X' (or Y') is constructed of a transparent electrode Xa' (or Ya') formed of a transparent conductive film of a larger width made of ITO or the like, and a bus electrodes Xb' (or Yb') formed of a metal film of a smaller width assisting the electrical conductivity of the corresponding transparent electrode. The row electrodes X' and Y' are arranged in alternate positions in the column direction such that protrusions Xa" and Ya" are formed on the mutually facing sides of adjacent row electrodes X' and Y' at regular intervals, and each protrusion Xa" faces the corresponding protrusion Ya" with a discharge gap g' interposed therebetween.

On the surface of the back glass substrate 4 facing the front glass substrate 1, a plurality of column electrodes D are regularly arranged and each extends in a direction at right angles to the row electrode pair (X', Y'). The column electrodes D are protected by a column-electrode protective layer 5.

Band-shaped partition walls 6 are formed on the column-electrode protective layer 5 and each extends in parallel with and between adjacent column electrodes D. Further, phosphor layers 7 having three primary colors are provided in order of a red color, green color and blue color in the column direction and each covers the side faces of adjacent partition walls 5 and the column electrode D.

The front glass substrate 1 and back glass substrate 4 designed as described above are situated opposite to and in parallel with each other to define a discharge space between them. The discharge space hermetically sealed between the front and back glass substrates 1 and 4 is filled with a discharge gas of a mixture of neon, xenon and the like.

The PDP includes discharge cells, defined in matrix form by the partition walls 6, in the discharge space at intersections of the row electrode pair (X', Y') and the column electrode D. Discharge is caused selectively in the discharge cells to form an image according to a video signal.

The PDP is typically manufactured with the following process.

First, as illustrated in FIG. 7, the front glass substrate 1 having the row electrode pairs (X', Y'), dielectric layer 2, and protective layer 3 formed thereon is placed opposite the back glass substrate 4 having the column electrodes D, column-electrode protective layer 5, partition walls 6 and phosphor layers 7 formed thereon. Then, sealing glass is provided to seal around the periphery of the front glass substrate 1 and the back glass substrate 4 for a hermetic seal of the space (discharge space) defined between the front and back glass substrates 1 and 4.

Then, a vacuum is created in the sealed discharge space via a ventilation hole provided in either one of the glass substrates, and then a discharge gas is introduced through the ventilation hole.

As illustrated in FIG. 8 and FIG. 9, the ventilation hole 8 for introducing the discharge gas is formed in a portion of one of the glass substrates (the back glass substrate 4 in the prior art example) which face a non-light-emission area where an image is not generated. The ventilation hole 8 is opened toward a space formed by a glass wall 9 constituted by sealing glass sealing around the periphery of the front glass substrate land back glass substrate 4, and a gas introduction rib 10 provided on the inner surface of the back glass substrate 4 to form a gas introduction path R between itself and the glass wall 9.

The ventilation hole 8 is connected to a gas introduction tube 11. The discharge gas is introduced from the gas introduction tube 11 via the ventilation hole 8, then passes through the gas introduction path R provided between the glass wall 9 and the gas introduction rib 10, to fill the discharge space defined between the front and back glass substrate 1 and 4. After that, the gas introduction tube 11 is closed to hermetically seal the discharge space.

In the above manufacturing process for the PDP, during the introduction of the discharge gas, undesired contaminated gas such as moisture vapor or the like easily mixes with the discharge gas. Due to the mixing, the impurity is adhered to the inner face of the discharge space near the ventilation hole 8 to cause degradation in the characteristics of MgO forming the protective layer 3. Therefore, there is a problem of unstable discharge properties in the above part of the discharge space where the characteristics of the MgO of the protective layer has been degraded.

Conventionally, various methods are adopted in order to remove the contaminated gas entering the inside of the discharge space during the feeding of the discharge gas as described above: for example, the gas introduction rib 10 provided on the back glass substrate 4 is used to form the gas introduction path R for introducing the discharge gas via the ventilation hole 8 into the discharge space in the display area of the PDP, and further an adsorbent layer, made of MgO or the like, for adsorption of the contaminated gas is provided on a face of the gas introduction rib 10, or alternatively, an island-shaped adsorbent rib (not shown) for adsorption of the contaminated gas is provided inside the gas introduction path R.

However, even in the adoption of the methods for removing the contaminated gas as described above, there is a problem of impossibility of completely removing the contaminated gas and therefore unstability remaining of the discharge properties in the discharge space in the vicinity of an end of the gas introduction rib 10 forming the gas introduction path R.

SUMMARY OF THE INVENTION

The present invention has been made to solve the above problems associated with the method of manufacturing the plasma display panels in the prior art as described above.

It is therefore a first object of the present invention to provide a method of manufacturing a plasma display panel which is capable of considerably approaching the perfect removal of contaminated gas entrained with a discharge gas introduced into a discharge space of the plasma display panel, to provide favorable discharge properties throughout the discharge space.

It is also a second object of the present invention to provide a plasma display panel which is capable of considerably approaching the perfect removal of contaminated gas entrained with a discharge gas introduced into a discharge space thereof and therefore of providing favorable discharge properties throughout the discharge space.

To attain the first object, according to a first feature of the present invention, a method of manufacturing a plasma display panel in which a first substrate provided on its inner surface with a plurality of row electrode pairs each extending in a row direction and arranged in a column direction to form display lines, a dielectric layer covering the row electrode pairs and a protective layer for protecting the dielectric layer, is placed opposite a second substrate provided on its inner surface with column electrodes each extending in the column direction and arranged in the row direction, to define a discharge space between the first and second substrates, then a seal is provided around outer edge portions of the first substrate and the second substrate to hermetically seal the discharge space, and then a discharge gas is introduced into the discharge space from a non-display area of the discharge space located outside a display area of the discharge space in which unit light-emitting areas are formed at the respective intersections of the row electrode pairs on the first substrate with the column electrodes on the second substrate, such method of manufacturing the plasma display panel comprises the steps of: providing a pair of discharge electrodes for causing a discharge within the non-display area of the discharge space; and applying a voltage between the pair of the discharge electrodes to initiate the discharge when the discharge gas is introduced into the discharge space or alternatively after the discharge gas has been introduced.

In the manufacturing process with the method of manufacturing the plasma display panel in the first feature, the seal is provided around the outer edge portions of the first substrate and the second substrate, which have been placed opposite each other with the discharge space interposed therebetween, to hermetically seal the discharge space.

After that, in the non-display area other than the display area in which a discharge is produced to emit light for displaying an image in the plasma display panel, when or after a discharge gas is introduced into the discharge space from, for example, a ventilation hole formed on either one of the first substrate and the second substrate, a voltage is applied between at least a pair of discharge electrodes provided in a position facing the non-display area of the discharge space in which the introduction of the discharge gas is provided, whereupon a discharge, referred to as the so-called aging discharge, is caused between the pair of discharge electrodes within the non-display area of the discharge space in which the introduction of the discharge gas is provided.

Due to the aging discharge, the protective layer or dielectric layer situated in a position facing the non-display area of the discharge space in which the introduction of the discharge gas is provided is activated, thus improving in adsorptive property for a contaminated gas, such as moisture vapor or the like, entrained with the discharge gas introduced into the discharge space.

According to the first feature, the present invention allows the removal of contaminated gas entrained with a discharge gas introduced into the discharge space of the plasma display panel during the manufacturing process for the plasma display panel to approach a state of perfection, and therefore the provision of satisfactory discharge properties throughout the discharge space.

To attain the first object, a method of manufacturing a plasma display panel has, in addition to the configuration of the first feature, a second feature of further comprising a step of placing a gas adsorptive member, formed of a gas adsorbent, in a position facing the discharge space within the non-display area of the discharge space in which the introduction of the discharge gas is provided.

According to the second feature, the so-called aging discharge caused between the pair of discharge electrodes in the non-display area of the discharge space activates the gas adsorptive member formed of the gas adsorbent and facing the non-display area of the discharge space in which the introduction of the discharge gas is provided, to allow enhancement in the adsorptive property for the contaminated gas, such as moisture vapor or the like, entrained with the discharge gas introduced in the discharge space. Thus, the contaminated gas entrained with a discharge gas is approximately completely removed.

To attain the first object, a method of manufacturing a plasma display panel has, in addition to the configuration of the second feature, a third feature in that the gas adsorbent forming the gas adsorptive member is magnesium oxide.

According to the third feature, magnesium oxide forming the gas adsorptive member facing the non-display area of the discharge space is activated by the so-called aging discharge caused within the non-display area of the discharge space. Due to activated magnesium oxide, the contaminated gas, such as moisture vapor or the like, entrained with the discharge gas is adsorbed approximately to perfection.

To attain the first object, a method of manufacturing a plasma display panel has, in addition to the configuration of the second feature, a fourth feature in that the gas adsorptive member is the protective layer facing the non-display area of the discharge space.

According to the fourth feature, the gas adsorptive member is constituted by a portion, facing the non-display area of the discharge space, of the protective layer formed of magnesium oxide or the like for protective the dielectric layer on the first substrate. The portion of the protective layer facing the non-display area of the discharge space is activated by the so-called aging discharge caused between the discharge electrodes, to adsorb the contaminated gas, such as moisture vapor or the like, entrained with the discharge gas approximately to perfection.

To attain the first object, a method of manufacturing a plasma display panel has, in addition to the configuration of the second feature, a fifth feature in that the gas adsorptive member is a rib member forming a path for introducing the discharge gas in the non-display area of the discharge space in which the introduction of the discharge gas is provided.

According to the fifth feature, the gas-introducing rib member, which protrudes, for example, from the inner surface of the second substrate into the discharge space so as to form an introduction path for the discharge gas introduced through a ventilation hole formed on the second substrate, is formed of a gas adsorbent, or alternatively, provided with a layer formed of a gas adsorbent on its surface, whereby the contaminated gas entrained with the discharge gas is adsorbed. Further, the so-called aging discharge is caused in the non-display area of the display space in which the rib member is provided, to activate the gas adsorbent forming the rib member. Thus, the contaminated gas is adsorbed approximately to perfection.

To attain the first object, a method of manufacturing a plasma display panel has, in addition to the configuration of the first feature, a sixth feature in that the pair of discharge electrodes are parts of the respective row electrodes constituting the row electrode pair, increased in length to continue extending from inside the display area into the non-display area.

According to the sixth feature, the parts of the respective row electrodes of the row electrode pair which is provided for causing a discharge for light emission in the display area of the plasma display panel, e.g., the bus electrodes provided for assisting the electrical conductivity of the mutually facing transparent electrodes provided for causing the discharge for light emission, are lengthened to continue extending from inside the display area of the plasma display panel into the non-display area. The parts extended in this way constitute the pair of discharge electrodes which face each other with a required spacing interposed therebetween and are situated in a position facing the non-display area of the discharge space in which the introduction of the discharge gas is provided.

A voltage is applied between the parts of the paired row electrodes formed so as to jut into the non-display area to initiate the so-called aging discharge in the non-display area of the discharge space in order to activate the gas adsorptive member.

To attain the first object, a method of manufacturing a plasma display panel has, in addition to the configuration of the sixth feature, a seventh feature in that at least one of the parts of the row electrodes increased in length to continue extending from inside the display area into the non-display area is cut after completion of the introduction of the discharge gas.

According to the seventh feature, when the discharge electrodes for producing the aging discharge are constituted by the parts of the respective row electrodes forming the row electrode pair which are so designed as to jut out of the display area into the non-display area, at least one of the parts of the row electrodes jutting into the non-display area is cut away by, e.g., a laser after completion of the introduction of the discharge gas and then the aging discharge.

This cutting process is needed in order to prevent occurrence of undesired light emission by the discharge in the non-display area during the operation of the plasma display panel for displaying an image.

This manner that only one of the parts of the row electrodes jutting into the non-display area is cut away and the other is not cut, makes it possible to use the other part which is not cut as an external connection terminal for the row electrodes.

To attain the first object, a method of manufacturing a plasma display panel has, in addition to the configuration of the first feature, an eighth feature in that the pair of the discharge electrodes are a part of one of the row electrodes constituting the row electrode pair, increased in length to continue extending from inside the display area into the non-display area, and the column electrode situated on a portion of the second substrate facing the non-display area.

According to the eighth feature, the part of one of the row electrodes of the row electrode pair provided for causing a discharge for light emission in the display area of the plasma display panel, e.g., one of the bus electrodes provided for assisting the electrical conductivity of the mutually facing transparent electrodes provided for causing the discharge for light emission, is lengthened to continue extending from inside the display area of the plasma display panel into the non-display area.

Further, the column electrode is provided on a portion of the second substrate facing the non-display area. The above part of the row electrode so formed as to jut into the non-display area and the above column electrode situated in the position facing the non-display area constitute the pair of discharge electrodes facing each other for causing the aging discharge with the discharge space in the non-display area of the plasma display panel interposed between the part and column electrode concerned.

A voltage is applied between the part of the row electrode so formed as to jut into the non-display area and the column electrode, to initiate the so-called aging discharge in the discharge space of the non-display area for activating the gas adsorptive member.

To attain the first object, a method of manufacturing a plasma display panel has, in addition to the configuration of the first feature, a ninth feature in that the pair of the discharge electrodes is a pair of the column electrodes placed parallel at an interval on a portion of the second substrate facing the non-display area.

According to the ninth feature, the column electrodes are placed on a portion of the second substrate facing the non-display area so as to be paired with each other with a required spacing therebetween. The paired column electrodes constitute the pair of discharge electrodes for causing the aging discharge.

A voltage is applied between the paired column electrodes to initiate the so-called aging discharge in the discharge space in the non-display area for activating the gas adsorptive member.

To attain the first object, a method of manufacturing a plasma display panel has, in addition to the configuration of the first feature, a tenth feature in that the pair of the discharge electrodes is a pair of external electrodes respectively placed on portions of the outer surfaces of the first substrate and the second substrate positioned on opposite sides of the non-display area.

According to the tenth feature, the external electrodes are respectively attached onto the portions, corresponding to the non-display area, of the outside surfaces of the first and second substrates which are opposite each other to defined the hermetically sealed discharge space therebetween. The external electrodes are placed on opposite sides of the discharge space in the non-display area of the plasma display panel to face each other in order to constitute the pair of discharge electrodes for causing the aging discharge.

A voltage is applied between the paired external electrodes to initiate the so-called aging discharge in the discharge space in the non-display area for activation of the gas adsorptive member.

To attain the second object, according to an eleventh feature of the present invention, a plasma display panel including: a first substrate having an inner surface on which a plurality of row electrode pairs each extend in a row direction and are arranged in a column direction to form display lines, a dielectric layer covers the row electrode pairs and a protective layer is provided for protecting the dielectric layer; and a second substrate positioned opposite the first substrate with a discharge space interposed between the first and second substrates, and having an inner surface facing the first substrate on which column electrodes each extend in the column direction and are arranged in the row direction to form unit light-emission areas in the discharge space at intersections with the row electrode pairs, a seal being provided around outer edge portions of the first substrate and the second substrate to hermetically seal the discharge space, the plasma display panel comprises a pair of discharge electrodes provided for causing a discharge in a non-display area situated outside a display area of the discharge space with the unit light-emission areas formed therein when a voltage is applied between the discharge electrodes.

With the plasma display panel in the eleventh feature, in the manufacturing process for the plasma display panel, the seal is provided around the outer edge portions of the first substrate and the second substrate, which have been placed opposite each other with the discharge space interposed therebetween, to hermetically seal the discharge space.

After that, in the non-display area other than the display area in which a discharge is produced to emit light for displaying an image on the plasma display panel, when or after a discharge gas is introduced into the discharge space from, for example, a ventilation hole formed on either one of the first substrate and the second substrate, a voltage is applied between at least a pair of discharge electrodes provided in a position facing the non-display area of the discharge space in which the introduction of the discharge gas is provided, whereupon a discharge, referred to as a so-called aging discharge, is caused between the pair of discharge electrodes in the non-display area of the discharge space in which the introduction of the discharge gas is provided.

Due to the aging discharge, the protective layer or dielectric layer situated in a position facing the non-display area of the discharge space in which the introduction of the discharge gas is provided is activated, thus improving in adsorptive property for a contaminated gas, such as moisture vapor or the like, entrained with the discharge gas introduced into the discharge space.

According to the eleventh feature, the present invention provides the plasma display panel capable of approaching the perfect removal of contaminated gas, entrained with a discharge gas introduced into the discharge space, in the manufacturing process for the plasma display panel, and therefore being capable of providing satisfactory discharge properties throughout the discharge space.

These and other objects and features of the present invention will become more apparent from the following detailed description with reference to the accompanying drawings.

DETAILED DESCRIPTION OF THE PREFERRED EMBODIMENT

A preferred embodiment according to the present invention will be described hereinafter in detail with reference to the accompanying drawings.

Figure 1:
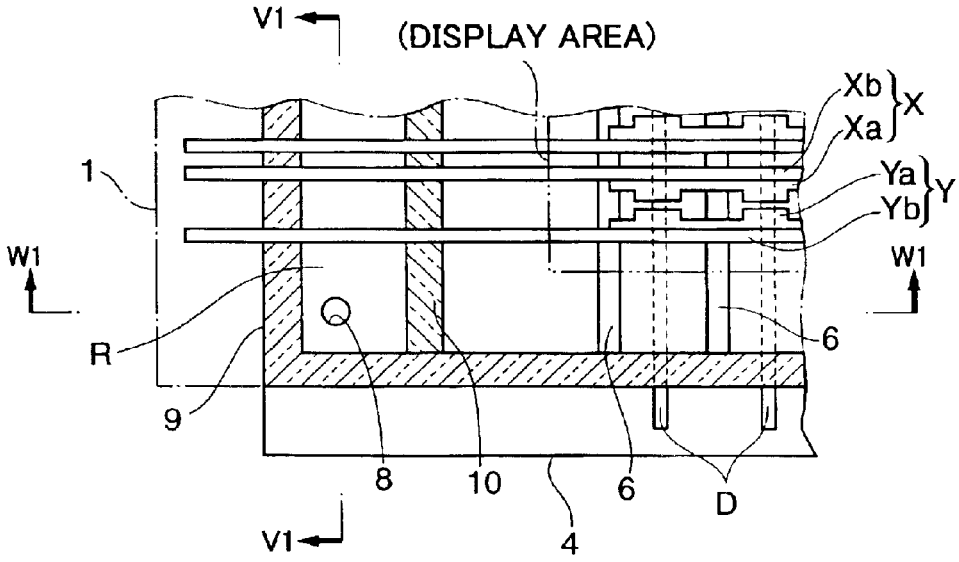
FIG. 1 is a schematically plan view illustrating part of a plasma display panel embodying a first embodiment according to the present invention.
Figure 2:
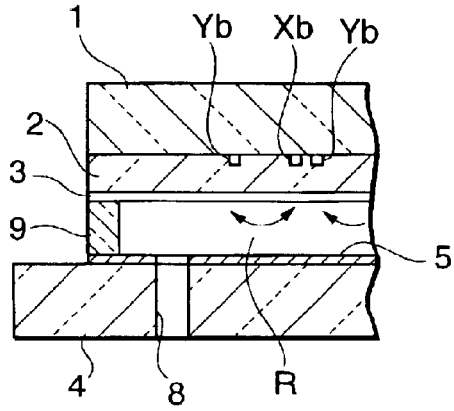
FIG. 2 is a sectional view taken along the V1—V1 line of FIG. 1.
Figure 3:
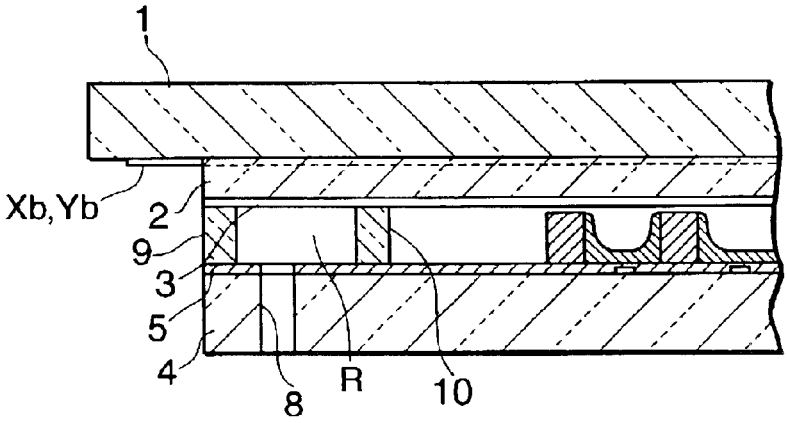
FIG. 3 is a sectional view taken along the W1—W1 line of FIG. 1.

FIG. 1 to FIG. 3 are provided for illustrating a first embodiment according to the present invention, in which FIG. 1 is a plan view illustrating the configuration of a part for introducing a discharge gas in a plasma display panel (hereinafter referred to as "PDP"), FIG. 2 is a sectional view taken along the V1—V1 line in FIG. 1, and FIG. 3 is a sectional view taken along the W1—W1 line in FIG. 1.

Figure 7:
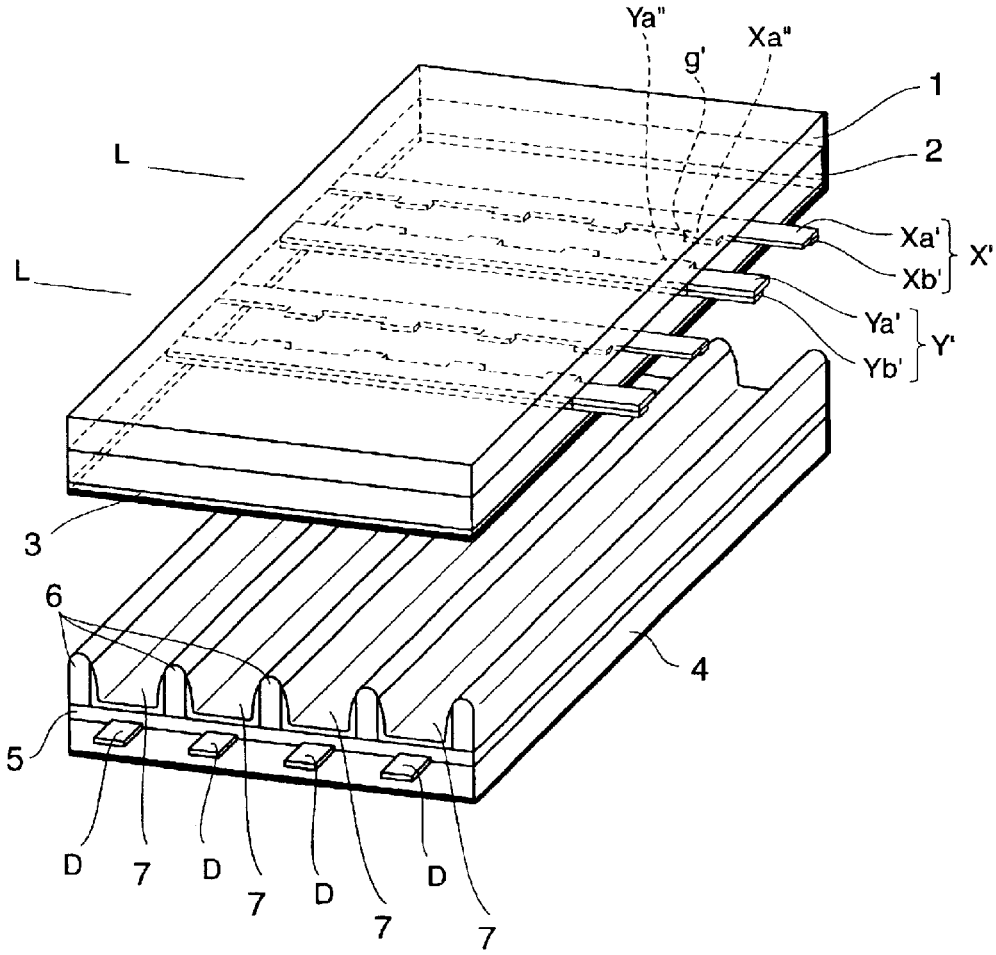
FIG.7 PRIOR ART
FIG. 7 is a perspective view illustrating the configuration of a plasma display panel of the prior art.
Figure 8:
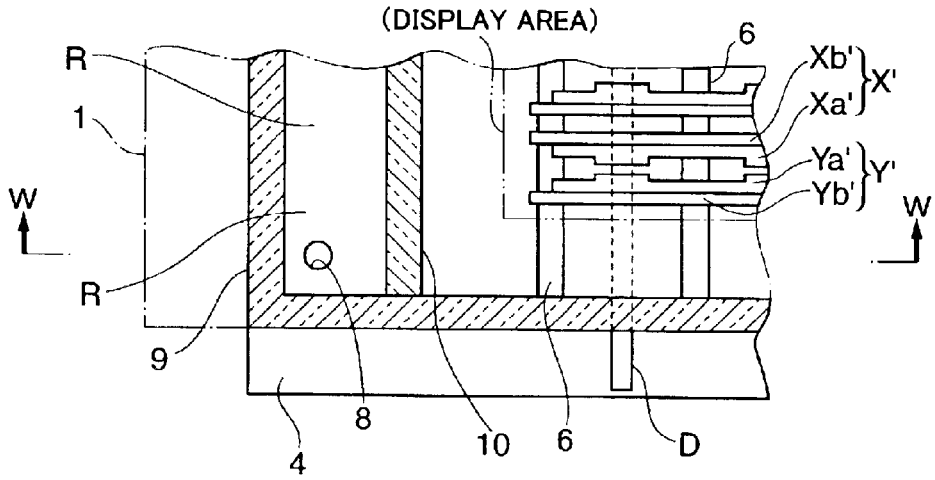
FIG.8 PRIOR ART
FIG. 8 is a front view illustrating the configuration of a part of the plasma display panel for introducing a discharge gas in the prior art.
Figure 9:
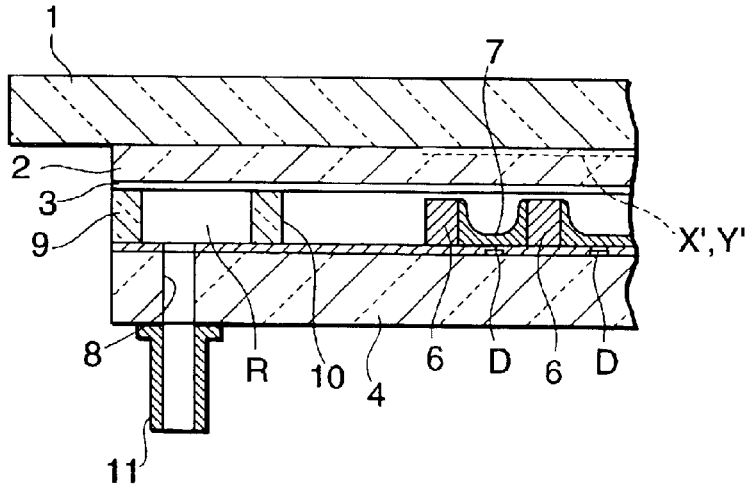
FIG.9 PRIOR ART
FIG. 9 is a sectional view taken along the W—W line in FIG. 8.

The PDP shown in FIGS. 1 to 3 has a configuration similar to that of the PDP described in the prior art example, except for a configuration of a row electrode pair which will be described below. Therefore the same components are designated by the same reference numerals as those used for the PDP in FIGS. 7 to 9.

In FIGS. 1 to 3, row electrode pairs (X, Y) each extend on a back surface of the front glass substrate 1 in a row direction (the right-left direction in FIG. 1), and are arranged parallel in a column direction (the vertical direction in FIG. 1).

Each of row electrodes X and Y constituting each row electrode pair (X, Y) includes a transparent electrode Xa, Ya and a bus electrode Xb, Yb.

Concerning the row electrode pairs (X, Y), in a step of forming the row electrodes X and Y on the front glass substrate 1 in the manufacturing process for the PDP, the bus electrodes Xb and Yb of the respective row electrodes X and Y are formed in a length allowing the extension thereof from the display area of displaying an image to a position in which a glass wall 9 will be formed for providing a seal between the outer peripheral edges of the front and back glass substrates 1 and 4 in a subsequent step of combining the front and back glass substrates 1 and 4.

With this design, after the front glass substrate 1 and the back glass substrate 4 are combined, the extended bus electrodes Xb and Yb of the row electrodes X and Y are situated in a position straddling a section including the gas introduction path R which will serve as a non-display area of the PDP, without a function of displaying an image.

In this situation that the front and back glass substrate 1 and 4 are combined and the bus electrodes Xb and Yb of the respective row electrodes X and Y straddle the section serving as the non-display area of the PDP, a discharge gas is introduced through a ventilation hole 8.

At this point, a voltage is applied between the bus electrodes Xb and Yb to initiate a discharge between the bus electrodes Xb and Yb (this discharge will be hereinafter called as "aging discharge").

The aging discharge activates an MgO layer constituting a protective layer 3 situated in the non-display area of the PDP, and also activates an MgO layer of a gas introduction rib 10 if the MgO layer for adsorption of undesired contaminated gas is provided on the gas introduction rib 10.

In this way, due to the aging discharge caused in the non-display area of the PDP when the discharge gas is introduced, the MgO layer facing the discharge space in the non-display area is activated to allow the MgO layer to approximately fully adsorb the contaminated gas entering during the introduction of the discharge gas.

Such adsorption provides increased stabilization of discharge properties within the discharge space, particularly, the display area in the discharge space in the vicinity of the boundary between the display area and the non-display area.

Parts of the bus electrodes Xb, Yb jutting into the non-display area of the PDP are cut away by a laser or the like after the aging discharge is produced, in order to prevent occurrence of light emission by an undesired discharge in the non-display area during operation for displaying an image.

At this point, if only one of the bus electrodes Xb, Yb is cut, the other bus electrode not cut can be used as a terminal for making external connection.

Due to the contaminated gas entering during the introduction of the discharge gas in the manufacturing process for the PDP, the discharge space in the vicinity of the ventilation hole 8 and an end of the gas introduction rib 10 if the rib 10 is provided has a high chance of the discharge properties becoming unstable. Therefore, in the manufacturing process for the PDP, the bus electrodes Xb, Yb jutting out from the display area of the PDP into the non-display area may be provided only in a position facing the non-display area next to the above region of the discharge space having a high chance of the discharge properties becoming unstable, in order to cause the aging discharge.

Figure 4:
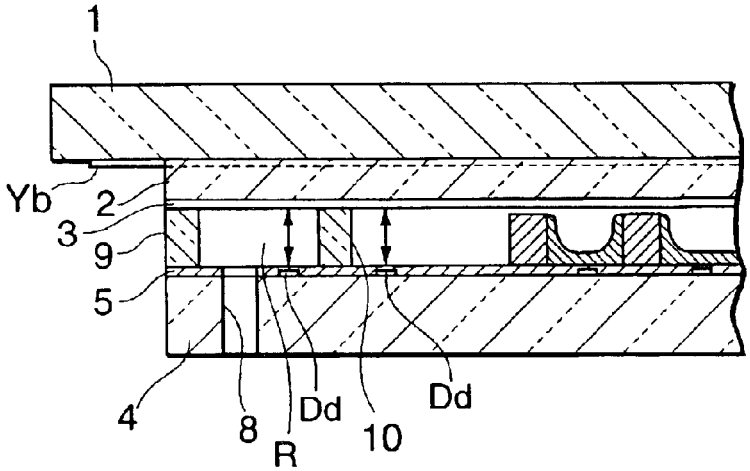
FIG. 4 is a schematically sectional view illustrating part of a plasma display panel embodying a second embodiment according to the present invention.

FIG. 4 is a sectional view illustrating the configuration of a discharge-gas introduction part of the PDP for describing a second embodiment of the method of manufacturing the PDP according to the present invention.

FIG. 4 is a sectional view cut away at the same position as that of the FIG. 3 illustrating the first embodiment, where one of the bus electrodes Xb, Yb of the row electrodes X, Y (the bus electrode Yb in FIG. 4) is so formed as to jut into the non-display area of the PDP.

In this non-display area of the PDP, a dummy address electrode Dd is provided on the face of the back glass substrate 4 facing the front the glass substrate 1.

FIG. 4 illustrates as an example the two dummy address electrodes Dd which are provided on a portion of the back glass substrate 4 in the non-display area on either side of the gas introduction rib 10, one facing inward toward the gas introduction path R and the other facing the non-display area on the other side of the gas introduction rib 10. However, either one of the above dummy address electrodes Dd, or alternatively the more than two dummy address electrodes, may be provided.

In the second embodiment, the aging discharge is caused between the dummy address electrode Dd and the bus electrode Yb jutting into the non-display area, to thereby activate the MgO layer constituting the protective layer 3 and the MgO layer formed on the gas introduction rib 10, resulting in the approximately perfect adsorption of the contaminated gas entrained with the discharge gas.

When the PDP is operated for displaying an image, electric current is not passed through the dummy address electrode Dd, so that there is no likelihood of occurrence of light emission by an undesired discharge in the non-display area.

In the second embodiment, the bus electrode Yb so formed as to jut into the non-display area of the PDP can be also used as a terminal for making external connection as it is.

Figure 5:
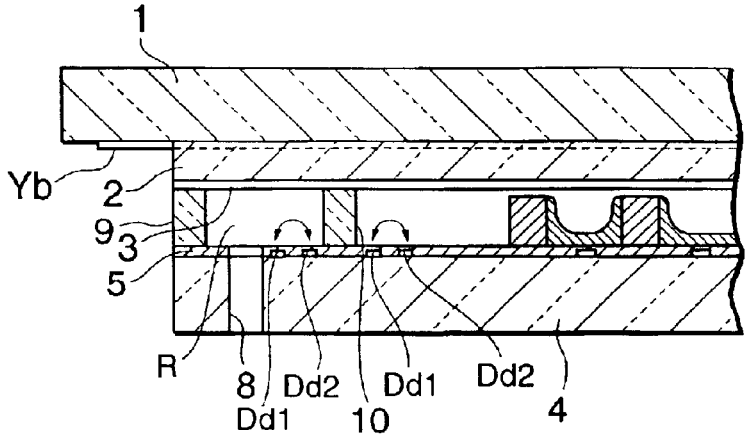
FIG. 5 is a schematically sectional view illustrating part of a plasma display panel embodying a third embodiment according to the present invention.

FIG. 5 is a sectional view illustrating the configuration of a discharge-gas introduction part of the PDP for describing a third embodiment of the method of manufacturing the PDP according to the present invention.

FIG. 5 is a sectional view cut away at the same position as that of the FIG. 3 in the first embodiment, where in the non-display area of the PDP, paired dummy address electrodes Dd1 and Dd2 are formed on the face of the back glass substrate 4 facing the front glass substrate 1 and extend in parallel with each other at a required interval.

FIG. 5 illustrates as an example paired dummy address electrodes Dd1 and Dd2 which are provided on a portion of the back glass substrate 4 in the non-display area on either side of the gas introduction rib 10, one pair facing inward toward the gas introduction path R and the other pair facing the non-display area on the other side of the gas introduction rib 10. However, either one of the above two pairs of dummy address electrodes Dd1 and Dd2, or alternatively the more than two pairs of dummy address electrodes, may be provided.

In the third embodiment, the aging discharge is caused between each pair of the dummy address electrodes Dd1 and Dd2, to thereby activate the MgO layer constituting the protective layer 3 and the MgO layer formed on the gas introduction rib 10, resulting in the approximately perfect adsorption of the contaminated gas entrained with the discharge gas.

When the PDP is operated for displaying an image, electric current is not passed through the dummy address electrodes Dd1 and Dd2, so that there is no likelihood of occurrence of light emission by an undesired discharge in the non-display area.

In the third embodiment, the bus electrode Yb is so formed as to jut into the non-display area of the PDP for the use as a terminal for making external connection as it is.

Figure 6:
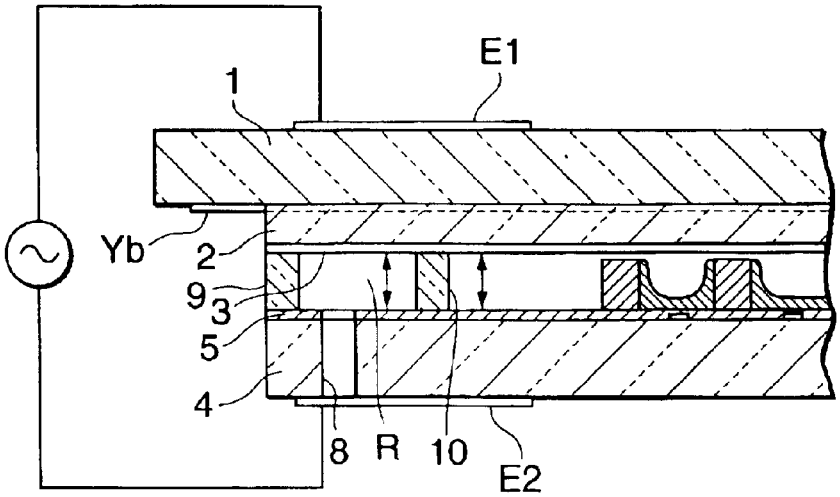
FIG. 6 is a schematically sectional view illustrating part of a plasma display panel embodying a fourth embodiment according to the present invention.

FIG. 6 is a sectional view illustrating the configuration of a discharge-gas introduction part of the PDP for describing a fourth embodiment of the method of manufacturing the PDP according to the present invention.

FIG. 6 is a sectional view cut away at the same position as that of the FIG. 3 in the first embodiment, where in the manufacturing process for the PDP, after the discharge space is hermetically sealed with the glass wall 9, a pair of external electrodes E1 and E2 are attached respectively onto portions of the front surface of the front glass substrate 1 and of the rear surface of the back glass substrate 4 which are situated in positions corresponding to the non-display area of the PDP.

A high-voltage, high-frequency pulse is applied between the external electrodes E1 and E2 to initiate the aging discharge between the external electrodes E1 and E2 within the discharge space in the non-display area of the PDP. Thus, the MgO layer constituting the protective layer 3 and the MgO layer formed on the gas introduction rib 10 are activated to approximately completely adsorb the contaminated gas entrained with the discharge gas.

The external electrodes E1, E2 are detached after the producing of the aging discharge.

In the fourth embodiment, the bus electrode Yb is so formed as to jut into the non-display area of the PDP for the use as a terminal for making external connection as it is.

In each of the foregoing embodiments, in order to cause the aging discharge in the non-display area of the PDP, a discharge cell for aging is provided in the non-display area, and a pair of bus electrodes or transparent electrodes having a larger spacing therebetween than that in a discharge cell in the display area, for example, may be provided in a position facing the aging discharge cell for the setting of a higher voltage for starting a discharge in the aging discharge cell as compared with a discharge starting voltage in the discharge cell in the display area.

With this design, a higher voltage pulse as compared with that in the displaying operation of the PDP can be applied between the pair of bus electrodes or transparent electrodes which face the aging discharge cell in order to cause the aging discharge in the discharge space of the non-display area of the PDP only during the manufacturing process for the PDP.

Further, each of the foregoing embodiments describes the configuration that the MgO layer provided in the non-display area is activated by the aging discharge, but the present invention is not limited to this. For example, a surface of the dielectric layer, an inner face of the glass wall, and a side face of the gas introduction rib may be designed so as to be activated by the aging discharge as in the case the MgO layer is activated.

Still further, if surfaces facing the discharge space of the non-display area, as well as the area in the vicinity of the ventilation hole, are designed to be activated by the aging discharge, it is possible to enhance in adsorption of a contaminated gas released from peripheral frit (the glass wall 9) as well as the contaminated gas entrained with the discharge gas.

The terms and description used herein are set forth by way of illustration only and are not meant as limitations. Those skilled in the art will recognize that numerous variations are possible within the spirit and scope of the invention as defined in the following claims.

What is claimed is:

1. A method of manufacturing a plasma display panel in which a first substrate provided on its inner surface with a plurality of row electrode pairs each extending in a row direction and arranged in a column direction to form display lines, a dielectric layer covering the row electrode pairs and a protective layer for protecting the dielectric layer, is placed opposite a second substrate provided on its inner surface with column electrodes each extending in the column direction and arranged in the row direction, to define a discharge space between the first and second substrates, then a seal is provided around outer edge portions of the first substrate and the second substrate to hermetically seal the discharge space, and then a discharge gas is introduced into the discharge space from a non-display area of the discharge space located outside a display area of the discharge space in which unit light-emitting areas are formed at the respective intersections of the row electrode pairs on the first substrate with the column electrodes on the second substrate, said method of manufacturing the plasma display panel comprising the steps of:

providing a pair of discharge electrodes for causing a discharge in the non-display area of the discharge space;

applying a voltage between the pair of the discharge electrodes to initiate the discharge when the discharge gas is introduced into the discharge space or alternatively after the discharge gas has been introduced; and placing a gas adsorptive member, formed of a gas adsorbent, in a position facing the discharge space in said non-display area of the discharge space in which the introduction of the discharge gas is provided, wherein said gas adsorptive member is a rib member forming a path for introducing the discharge gas in the non-display area of the discharge space in which the introduction of the discharge gas is provided.

2. A method of manufacturing a plasma display panel according to claim 1, wherein the gas adsorbent forming said gas adsorptive member is magnesium oxide.

3. A method of manufacturing a plasma display panel according to claim 1, wherein said gas adsorptive member is said protective layer facing the non-display area of the discharge space.

4. A method of manufacturing a plasma display panel according to claim 1, wherein said pair of the discharge electrodes are parts of the respective row electrodes constituting the row electrode pair, increased in length to continue extending from inside the display area into the non-display area.

5. A method of manufacturing a plasma display panel according to claim 4, wherein at least one of the parts of the row electrodes increased in length to continue extending from inside the display area into the non-display area is cut after completion of the introduction of the discharge gas.

6. A method of manufacturing a plasma display panel according to claim 1, wherein said pair of the discharge electrodes are a part of one of the row electrodes constituting the row electrode pair, increased in length to continue extending from inside the display area into the non-display area, and the column electrode situated on a portion of the second substrate facing the non-display area.

7. A method of manufacturing a plasma display panel according to claim 1, wherein said pair of the discharge electrodes is a pair of the column electrodes placed parallel at an interval on a portion of the second substrate facing the non-display area.

8. A method of manufacturing a plasma display panel according to claim 1, wherein said pair of the discharge electrodes is a pair of external electrodes respectively placed on portions of the outer surfaces of the first substrate and the second substrate positioned on opposite sides of the non-display area.

9. A method of manufacturing a plasma display panel in which a first substrate provided on its inner surface with a plurality of row electrode pairs each extending in a row direction and arranged in a column direction to form display lines, a dielectric layer covering the row electrode pairs and a protective layer for protecting the dielectric layer, is placed opposite a second substrate provided on its inner surface with column electrodes each extending in the column direction and arranged in the row direction, to define a discharge space between the first and second substrates, then a seal is provided around outer edge portions of the first substrate and the second substrate to hermetically seal the discharge space, and then a discharge gas is introduced into the discharge space from a non-display area of the discharge space located outside a display area of the discharge space in which unit light-emitting areas are formed at the respective intersections of the row electrode pairs on the first substrate with the column electrodes on the second substrate, said method of manufacturing the plasma display panel comprising the steps of:

providing a pair of discharge electrodes for causing a discharge in the non-display area of the discharge space; and applying a voltage between the pair of the discharge electrodes to initiate the discharge when the discharge gas is introduced into the discharge space or alternatively after the discharge gas has been introduced, wherein said pair of the discharge electrodes are parts of the respective row electrodes constituting the row electrode pair, increased in length to continue extending from inside the display area into the non-display area.

10. A method of manufacturing a plasma display panel according to claim 9, further comprising a step of placing a gas adsorptive member, formed of a gas adsorbent, in a position facing the discharge space in said non-display area of the discharge space in which the introduction of the discharge gas is provided.

11. A method of manufacturing a plasma display panel according to claim 10, wherein the gas adsorbent forming said gas adsorptive member is magnesium oxide.

12. A method of manufacturing a plasma display panel according to claim 10, wherein said gas adsorptive member is said protective layer facing the non-display area of the discharge space.

13. A method of manufacturing a plasma display panel according to claim 9, wherein at least one of the parts of the row electrodes increased in length to continue extending from inside the display area into the non-display area is cut after completion of the introduction of the discharge gas.

14. A method of manufacturing a plasma display panel according to claim 9, wherein said pair of the discharge electrodes are a part of one of the row electrodes constituting the row electrode pair, increased in length to continue extending from inside the display area into the non-display area, and the column electrode situated on a portion of the second substrate facing the non-display area.

15. A method of manufacturing a plasma display panel according to claim 9, wherein said pair of the discharge electrodes is a pair of the column electrodes placed parallel at an interval on a portion of the second substrate facing the non-display area.

16. A method of manufacturing a plasma display panel according to claim 9, wherein said pair of the discharge electrodes is a pair of external electrodes respectively placed on portions of the outer surfaces of the first substrate and the second substrate positioned on opposite sides of the non-display area.

* * * * *